US007074167B1

(12) United States Patent
Chen

(10) Patent No.: US 7,074,167 B1
(45) Date of Patent: Jul. 11, 2006

(54) TWISTER

(76) Inventor: Chiu Ku Chen, No. 171, Wuchuan 5th Street, West Dist., Taichung 40346 (TW)

( * ) Notice: Subject to any disclaimer, the term of this patent is extended or adjusted under 35 U.S.C. 154(b) by 0 days.

(21) Appl. No.: 11/100,119

(22) Filed: Apr. 5, 2005

(51) Int. Cl.
*A63B 22/14* (2006.01)
*A63B 22/16* (2006.01)

(52) U.S. Cl. ..... 482/146; 482/147; 482/34; D21/685

(58) Field of Classification Search ..... 482/146–147, 482/34, 79, 80; D21/685–689, 399
See application file for complete search history.

(56) References Cited

U.S. PATENT DOCUMENTS 5,256,127 A * 10/1993 Yeh ..... 482/146
5,492,521 A * 2/1996 Wilkinson et al. ..... 482/147
5,632,711 A * 5/1997 Hwang ..... 482/147
5,888,182 A * 3/1999 Shih ..... 482/147
2003/0092546 A1* 5/2003 Yu ..... 482/142

* cited by examiner

*Primary Examiner*—Lori Amerson
(74) *Attorney, Agent, or Firm*—Charles E. Baxley

(57) ABSTRACT

A twister includes a follower slidably attached onto a housing and having a channel and a rack, a rod rotatably attached to the housing, a lever secured to the rod and having a pin attached to a free end and slidably engaged in the channel of the follower, to allow the follower to be forced to slide relative to the housing in a reciprocating action when the pin and the lever are rotated relative to the housing. An axle is rotatably engaged to the housing and includes a pinion engaged with the rack of the follower, to allow the axle to be rotated in a reciprocating action when the follower slides relative to the housing in the reciprocating action. A foot support is secured to the axle and driven by a motor.

6 Claims, 5 Drawing Sheets

TWISTER

BACKGROUND OF THE INVENTION

1. Field of the Invention

The present invention relates to a twister, and more particularly to an automatic twister having a foot support twistable or rotatable by a motor driving mechanism automatically.

2. Description of the Prior Art

Typical twisters comprise a foot support rotatably supported on a base, to support users thereon, and for allowing the foot support to be rotated or swung or twisted by the users, to conduct various kinds of twisting exercises.

For example, U.S. Pat. No. 5,632,711 to Hwang discloses one of the typical twisters comprising a foot support rotatably supported on a base, to support users thereon, and a handle or a rocker rotatably attached to the base, and coupled to the foot support with a link, to allow the foot support to be rotated or swung or twisted by the users via the handle or rocker, and a hydraulic cylinder coupled to the foot support, to apply a resistive force against the rotational movement of the foot support.

However, such typical twisters are suitable for being used and operated by young men or stronger persons who should spend a great energy to operate and to rotate the foot support, but may not be operated by the other people.

U.S. Pat. No. 5,888,182 to Shih discloses another typical rotary exerciser comprising a foot support rotatably supported on a base, to support users thereon, to allow the foot support to be rotated or swung or twisted by the users. However, similarly, such typical twisters are suitable for being used and operated by young men or stronger persons, but may not be operated by the other people.

The present invention has arisen to mitigate and/or obviate the afore-described disadvantages of the conventional twisters.

SUMMARY OF THE INVENTION

The primary objective of the present invention is to provide an automatic twister including a foot support twistable or rotatable by a motor driving mechanism automatically.

In accordance with one aspect of the invention, there is provided a twister comprising a base including a housing disposed thereon, a follower slidably attached onto the housing, and slidable relative to the housing in a reciprocating action, and including a channel formed therein, and including a rack provided thereon, a rod rotatably attached to the housing, a lever including a first end secured to the rod and rotated in concert with the rod, and including a second end, a pin attached to the second end of the lever and slidably engaged in the channel of the follower, to allow the follower to be forced to slide relative to the housing in the reciprocating action when the pin and the second end of the lever are rotated relative to the housing, an axle rotatably engaged to the housing, and including a pinion secured thereon and rotated in concert with each other, and engaged with the rack of the follower, to allow the axle to be rotated in one direction and then in the other direction when the follower slides relative to the housing in the reciprocating action, a foot support secured to the axle and rotated in concert with the axle, and a rotating device for rotating the rod relative to the housing, to rotate the lever to move the follower to slide relative to the housing in the reciprocating action, and to drive the axle and the foot support to rotate relative to the housing in a reciprocating action.

The housing includes at least one shaft disposed thereon, and the follower is slidably attached onto the shaft of the housing, for allowing the follower to slide relative to the housing. The housing further includes a second shaft disposed thereon, and arranged parallel to the shaft.

The housing includes a casing provided thereon and having a bore formed therein, to rotatably receive the axle therein. The rotating device includes a gear secured to the rod, and a motor coupled to the gear, to rotate the gear and the rod relative to the housing. The motor includes a spindle having a worm provided thereon, and engaged with the gear.

The rotating device includes a receptacle secured to the housing, and the gear is rotatably received in the receptacle. The housing includes a platform provided therein, and a chamber formed therein and defined below the platform to receive the receptacle.

The base includes an outer cover secured thereon, and engaged onto the follower and the housing, to cover and shield the follower and the housing, the outer cover includes a perforation formed therein, for rotatably receiving the axle, to allow the axle to be extended out of the outer cover, and includes a recess formed in an upper portion thereof, to rotatably receive the foot support therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
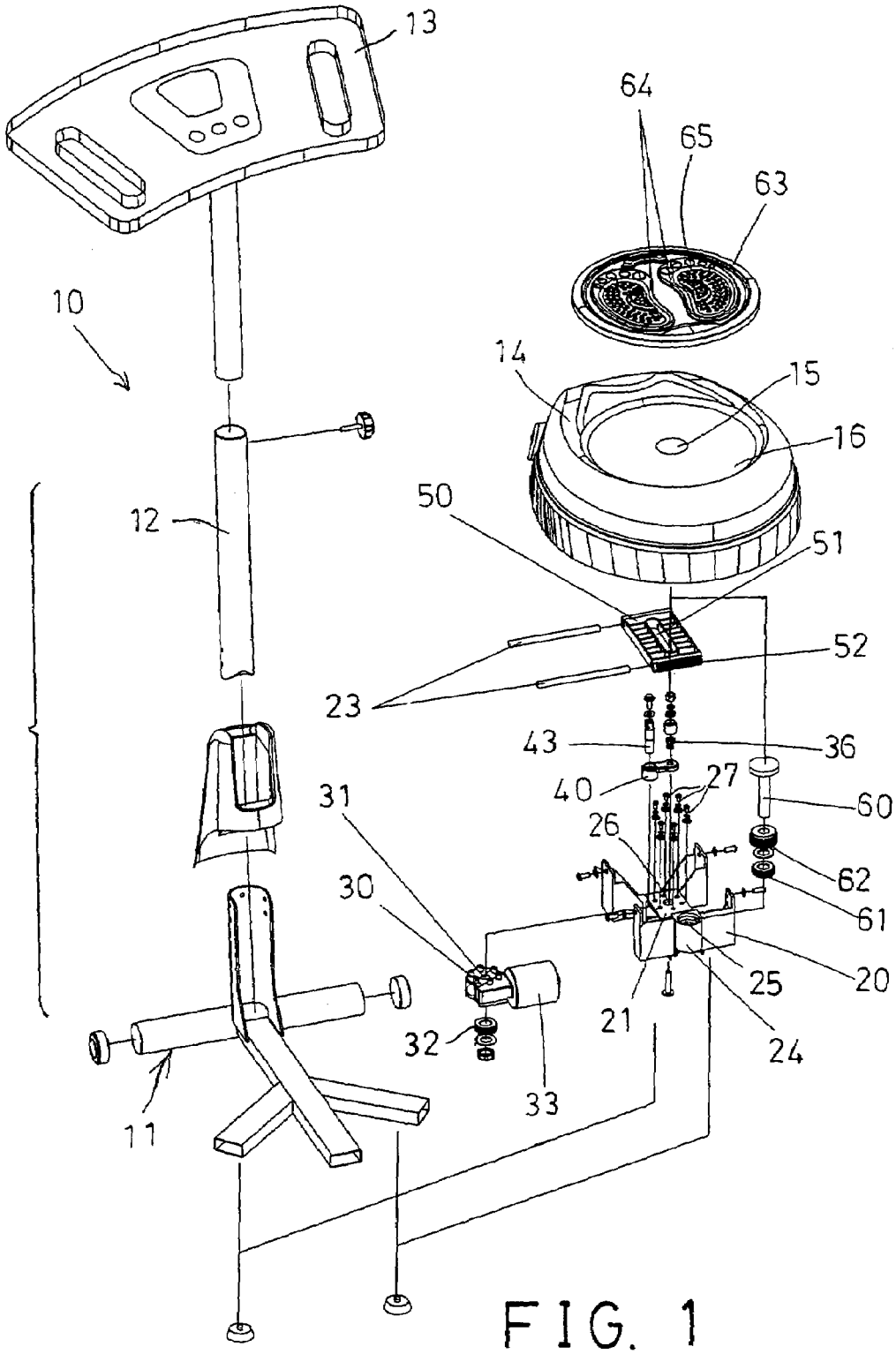
FIG. 1 is a partial exploded view of an automatic twister in accordance with the present invention.
Figure 3:
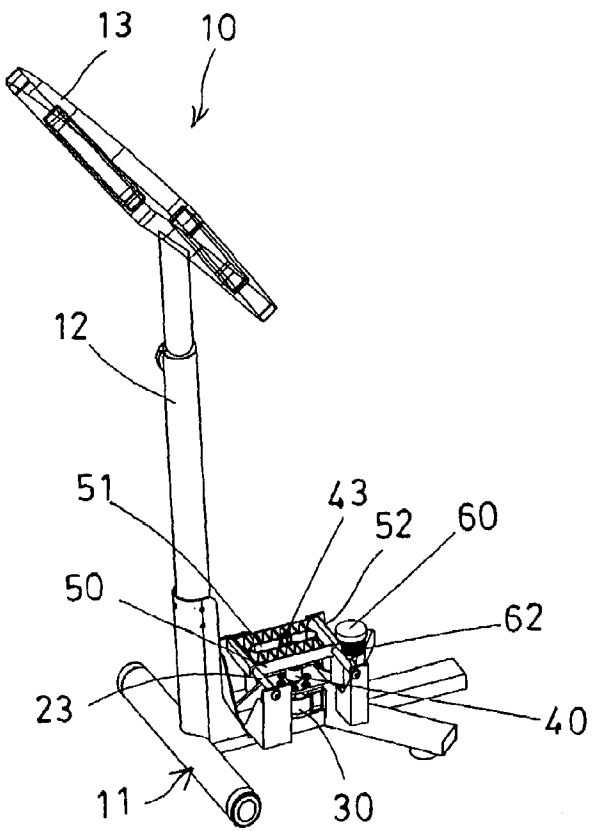
FIG. 3 is a perspective view similar to FIG. 2, in which an outer cover and a foot support of the twister have been removed, for showing an inner structure of the twister.
Figure 2:
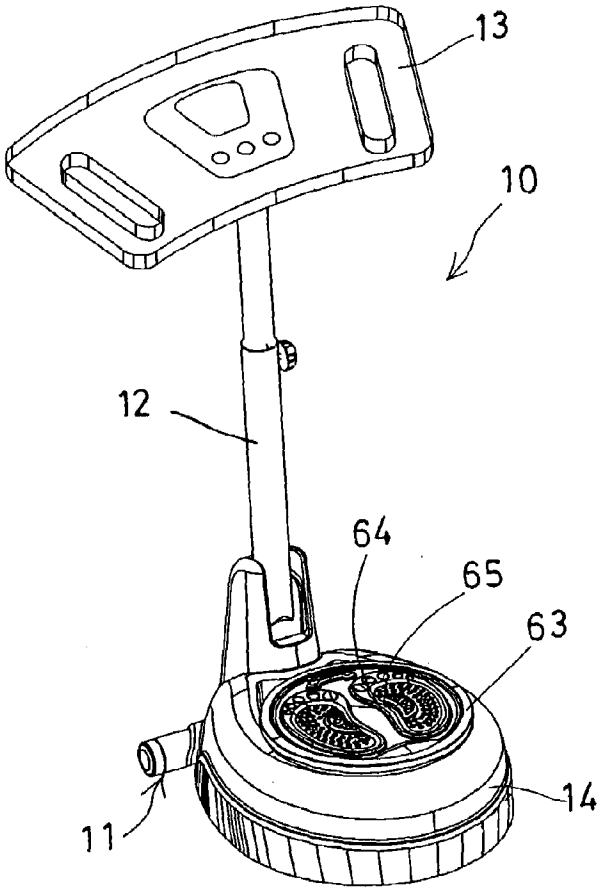
FIG. 2 is a perspective view of the automatic twister.

Referring to the drawings, and initially to FIGS. 1–5, an automatic twister 10 in accordance with the present invention comprises a base 11 including a post 12 extended upwardly therefrom, such as extended upwardly from the front portion thereof, to support a control device or control panel 13 thereon, and including a frame or housing 20 disposed or secured thereon. The housing 20 includes a platform 21 provided therein, and a chamber 22 formed therein and defined below the platform 21.

The housing 20 further includes one or more shafts 23 provided or disposed thereon, and preferably parallel to each other, and includes a casing 24 formed or provided on one side of the housing 20 and having a bore 25 formed therein (FIG. 1). The platform 21 of the housing 20 includes an orifice 26 formed therein (FIG. 1), and communicating with the chamber 22 thereof.

A receptacle 30 is engaged into the chamber 22 of the housing 20, and disposed below the platform 21, and secured to the platform 21 with one or more fasteners 27, and includes an aperture 31 formed therein and aligned with the orifice 26 of the platform 21 of the housing 20. A gear 32 is rotatably received or engaged within the receptacle 30. A motor 33 is attached to the platform 21 of the housing 20, or attached to the receptacle 30 with such as fasteners (not shown), and includes a spindle 34 having a worm 35 formed or provided thereon (FIG. 5), for engaging with the gear 32, and for rotating or driving the gear 32.

A rod 36 (FIGS. 4, 5) is engaged through the orifice 26 of the platform 21 and the aperture 31 of the receptacle 30, and thus rotatably attached to the platform 21 of the housing 20 and the receptacle 30, and secured to the gear 32, for being rotated or driven by the motor 33 via the gear 32 and the worm 35. The motor 33 and the worm 35 and the gear 32 may thus be formed as a driving means or device for rotating or for driving the rod 36 to rotate relative to the platform 21 of the housing 20 and the receptacle 30.

Figure 4:
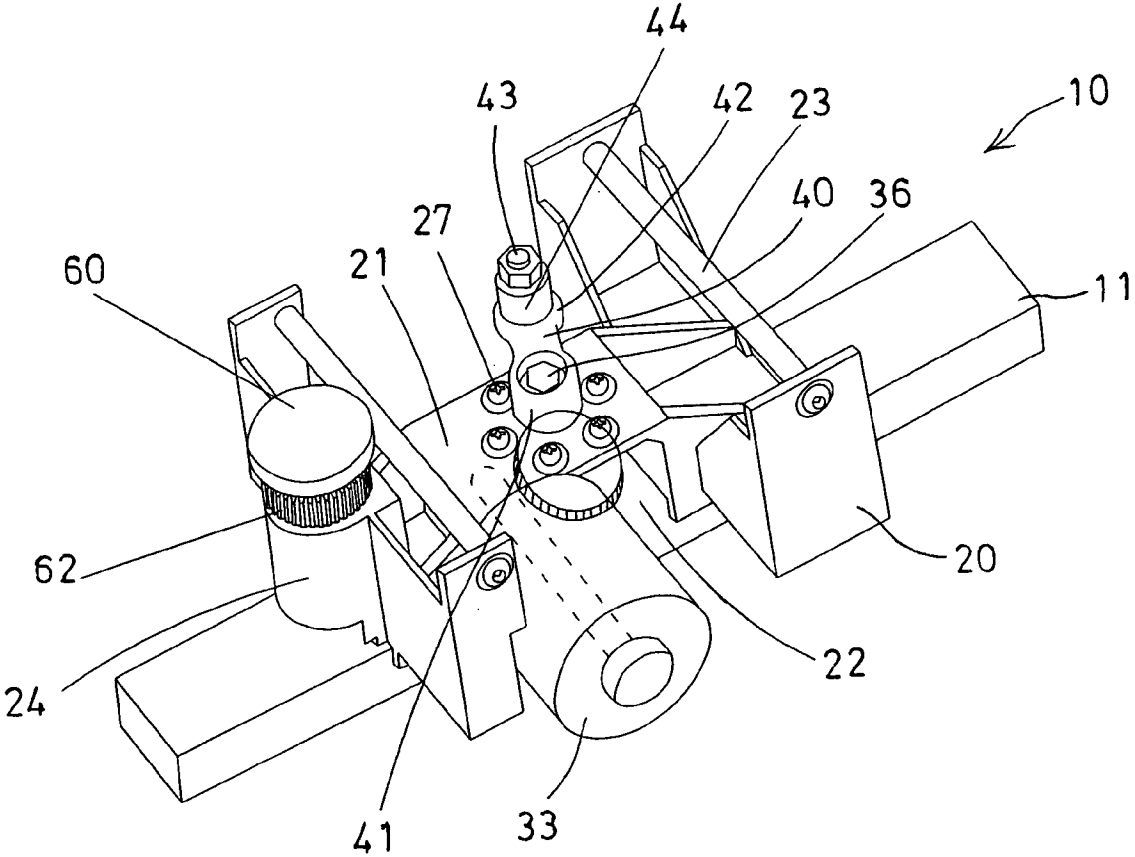
FIG. 4 is an enlarged partial perspective view of the automatic twister.
Figure 5:
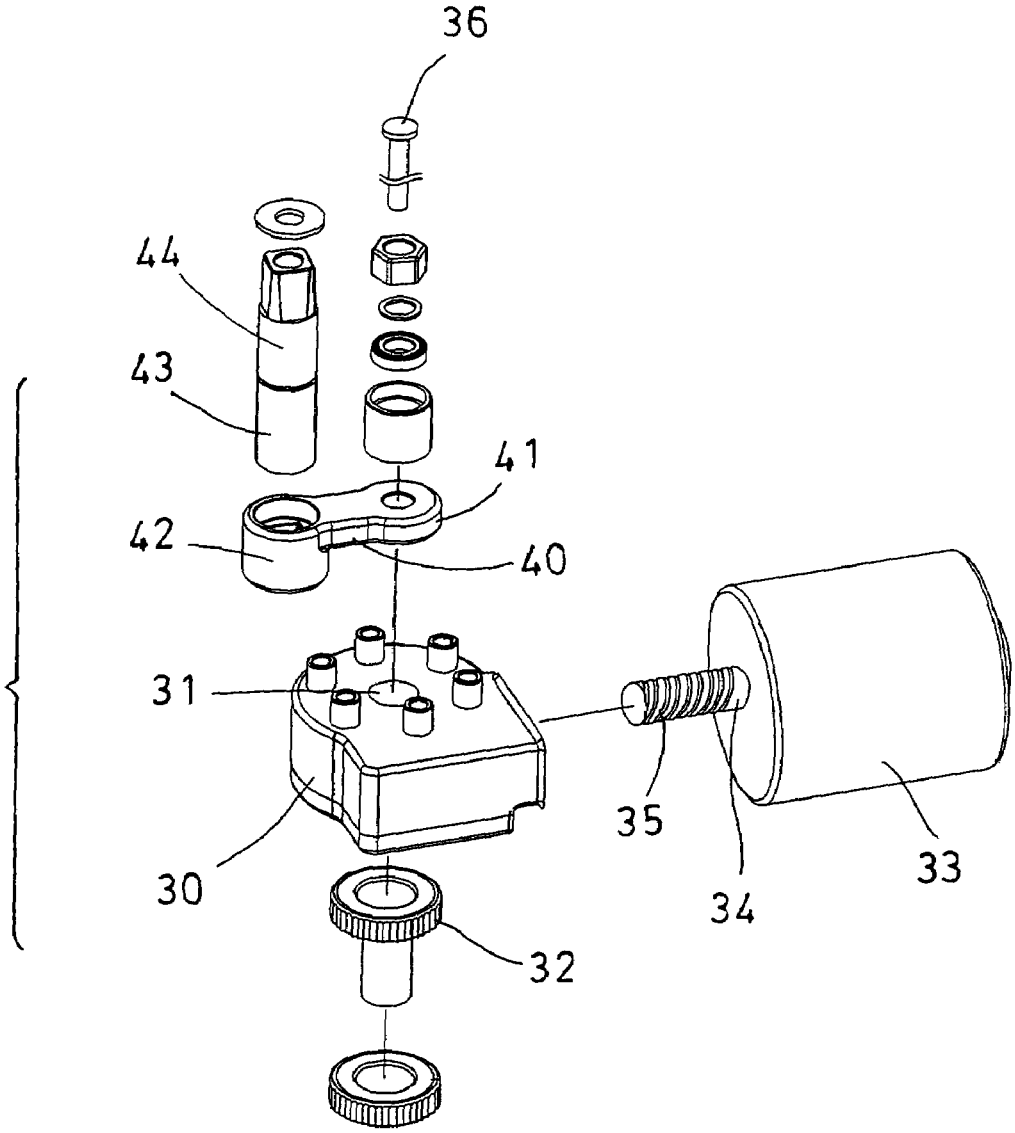
FIG. 5 is an enlarged partial exploded view of the automatic twister.

As also shown in FIGS. 4, 5, a lever 40 includes one end 41 secured to the rod 36, and rotated in concert with the gear 32, for being rotated or driven by the motor 33 via the gear 32 and the rod 36. The lever 40 includes another end 42 rotatable relative to the platform 21 and the receptacle 30 about or around the rod 36, for attaching or supporting a pin 43 thereto or thereon. A roller or bearing 44 (FIG. 4) may further be provided and attached onto the pin 43.

Figure 7:
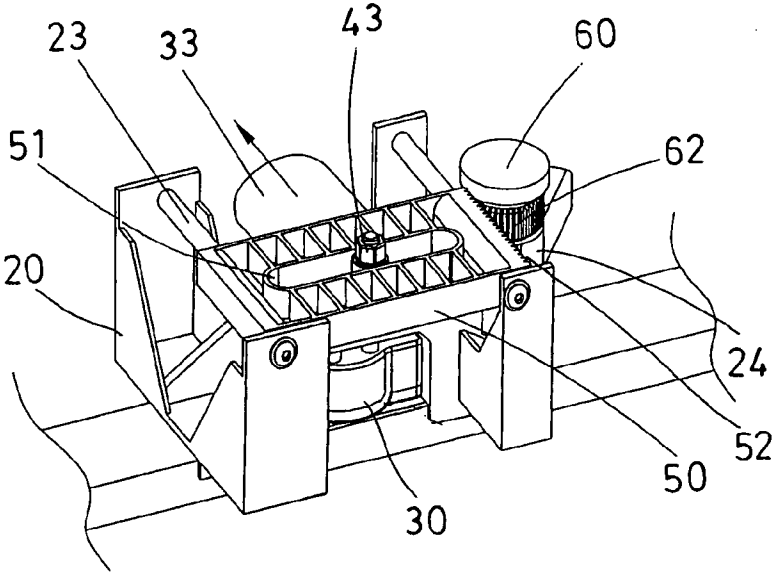
FIG. 7 is a further enlarged partial perspective view similar to FIG. 6, illustrating the operation of the twister.
Figure 6:
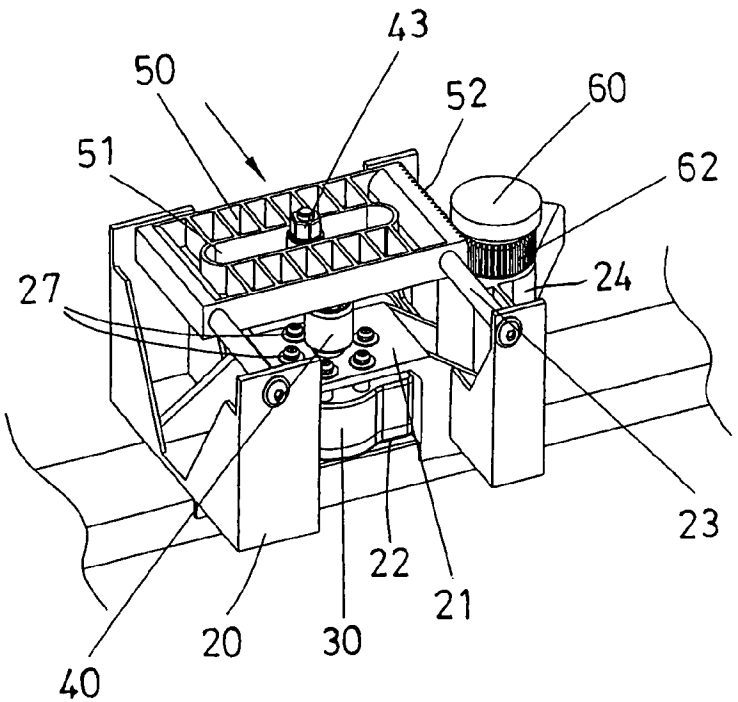
FIG. 6 is another enlarged partial perspective view of the automatic twister.

A slide or follower 50 is slidably attached onto the shafts 23 of the housing 20, for allowing the follower 50 to slide relative to the housing 20, and includes an oblong hole or a channel 51 formed therein, and includes a rack 52 formed or provided on one side thereof. The pin 43 itself or the roller or bearing 44 of the pin 43 is slidably engaged in the channel 51 of the follower 50, to allow the follower 50 to be forced to slide along the shafts 23 of the housing 20 in a reciprocating action when the pin 43 and the other end 42 of the lever 40 are rotated relative to the platform 21 and the receptacle 30 by the motor 33 (FIGS. 6, 7).

An axle 60 is rotatably engaged into the bore 25 of the casing 24 of the housing 20, and rotatably secured to the casing 24 or directly to the housing 20 with one or more bearings 61 (FIG. 1), and includes a pinion 62 secured thereon and rotated in concert with each other. The pinion 62 is engaged with the rack 52 of the follower 50, to allow the axle 60 to be rotated or driven in one direction when the follower 50 slides toward one end of the shafts 23 of the housing 20, and to allow the axle 60 to be rotated or driven in the other direction when the follower 50 slides toward the other end of the shafts 23 of the housing 20.

A shield or an outer cover 14 may further be provided and secured onto the base 11, and engaged onto the follower 50 and the housing 20 and the motor 33, in order to cover and to shield the follower 50 and the housing 20 and the motor 33. The outer cover 14 includes a perforation 15 formed therein, for rotatably receiving the axle 60, and to allow the axle 60 to be extended out of the outer cover 14. It is preferable that the outer cover 14 includes a recess 16 formed in the upper portion thereof.

A rotary foot support 63 may be rotatably engaged or received in the recess 16 of the outer cover 14, and secured to the axle 60, to allow the foot support 63 to be rotated in concert with the axle 60. The foot support 63 includes one or more, such as two foot pedal areas 64 formed or provided thereon, and each having a number of protrusions 65 extended upwardly therefrom, for engaging with and for massaging the feet of the users. The foot pedal areas 64 and the protrusions 65 are preferably made of rubber or other soft materials, for comfortably engaging with the users.

In operation, as shown in FIGS. 6 and 7, when the motor 33 is energized or actuated, the follower 50 may be forced to slide along the shafts 23 of the housing 20 in a reciprocating action by the rotational movement of the pin 43 and the other end 42 of the lever 40, and the pinion 62 and thus the axle 60 may then be forced to be rotated in one direction and then to be rotated in the other direction in a reciprocating action, and the foot support 63 may also be forced to be rotated in one direction and then to be rotated in the other direction in a reciprocating action or in a twisting action, such that the foot support 63 may be used to twist the users automatically.

Accordingly, the automatic twister in accordance with the present invention includes a foot support twistable or rotatable by a motor driving mechanism automatically.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A twister comprising:

A base including a housing disposed thereon, said housing including at least one shaft disposed thereon, and a casing having a bore formed therein to rotatably receive a axle therein, said base including an outer cover secured thereon, said outer cover includes a perforation formed therein for rotatably receiving said axle, to allow said axle to be extended out of said outer cover, and includes a recess formed in an upper portion thereof, to rotatably receive a foot support, a follower slidably attached onto said at least one shaft of said housing, and said follower slideable relative to said housing in a reciprocating action, and said follower including a channel formed therein, and including a rack provided thereon, said outer cover is engaged onto said follower and said housing, to cover and shield a follower and said housing, a rod rotatably attached to said housing, a lever including a first end secured to said rod and rotated in concert with said rod, and including a second end, a pin attached to said second end of said lever and slidably engaged in said channel of said follower to allow said follower to be forced to slide relative to said housing in the reciprocating action when said pin and said second end of said lever are rotated relative to said housing, said axle rotatably engaged to said housing, and including a pinion secured thereon and rotated in concert with each other, and engaged with said rack of said follower, to allow said axle to be rotated in one direction and then in the other direction when said follower slides relative to said housing in the reciprocation action, a rotary foot support secured to said axle and rotated in concert with said axle, said foot support includes one or more foot pedal areas formed thereon and having a plurality of protrusions extended upwardly therefrom for engaging and massaging the feet of a user, means for rotating said rod relative to said housing to rotate said lever to move said follower to slide relative to said housing in the reciprocating action, and to drive said axle and said foot support to rotate relative to said housing in a reciprocating action.

2. The twister as claimed in claim 1, wherein said housing further includes a second shaft disposed thereon, and arranged parallel to said at least one shaft.

3. The twister as claimed in claim 1, wherein said rotating means includes a gear secured to said rod, and a motor coupled to said gear, to rotate said gear and said rod relative to said housing.

4. The twister as claimed in claim 3, wherein said motor includes a spindle having a worm provided thereon, and engaged with said gear.

5. The twister as claimed in claim 3, wherein said rotating means includes a receptacle secured to said housing, and said gear is rotatably received in said receptacle.

6. The twister as claimed in claim 5, wherein said housing includes a platform provided therein, and a chamber formed therein and defined below said platform to receive said receptacle.

* * * * *